US010969150B2

(12) United States Patent
Ji et al.

(10) Patent No.: US 10,969,150 B2
(45) Date of Patent: Apr. 6, 2021

(54) REFRIGERATOR ADOPTING LINEAR COMPRESSOR AND CONTROL METHOD THEREOF

(71) Applicant: QINGDAO HAIER JOINT STOCK CO., LTD., Qingdao (CN)

(72) Inventors: Lisheng Ji, Qingdao (CN); Jianru Liu, Qingdao (CN); Xiaobing Zhu, Qingdao (CN); Feifei Qi, Qingdao (CN); Shufeng Zhang, Qingdao (CN); Caiyun Zhao, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 325 days.

(21) Appl. No.: 15/770,203

(22) PCT Filed: Jun. 17, 2016

(86) PCT No.: PCT/CN2016/086167

§ 371 (c)(1),
(2) Date: Apr. 21, 2018

(87) PCT Pub. No.: WO2017/076002

PCT Pub. Date: May 11, 2017

(65) Prior Publication Data

US 2018/0306477 A1 Oct. 25, 2018

(30) Foreign Application Priority Data

Nov. 5, 2015 (CN) ..... 201510751457.0

(51) Int. Cl.

| | |
|---|---|
| ***F25B 49/02*** | (2006.01) |
| ***F25B 1/02*** | (2006.01) |
| ***F25D 29/00*** | (2006.01) |

(52) U.S. Cl.
CPC ..... *F25B 49/022* (2013.01); *F25B 1/02* (2013.01); *F25D 29/00* (2013.01);
(Continued)

(58) Field of Classification Search
None
See application file for complete search history.

(56) References Cited

U.S. PATENT DOCUMENTS 6,397,608 B1 * 6/2002 Sakuma ..... F25B 5/02 62/158
2010/0300127 A1 * 12/2010 Gu ..... F25B 40/04 62/115

(Continued)

FOREIGN PATENT DOCUMENTS

CN 1215145 A 4/1999
CN 103080676 A 5/2013

(Continued)

*Primary Examiner* — Edward F Landrum
*Assistant Examiner* — Daniel C Comings
(74) *Attorney, Agent, or Firm* — Cheng-Ju Chiang

(57) ABSTRACT

Disclosed is a refrigerator adopting a linear compressor and a control method thereof. The method includes: monitoring the temperature of an evaporator of the refrigerator; if the current temperature of the evaporator of the refrigerator is greater than or equal to a first preset temperature threshold, then invoking a noise reduction mode to actively reduce the heat exchange amount between the evaporator and a compartment of the refrigerator until the current temperature of the evaporator of the refrigerator is smaller than or equal to a second preset temperature threshold, and invoking a cooling mode to resume the normal heat exchange between the evaporator and the compartment of the refrigerator, wherein the first preset temperature threshold is higher than the second preset temperature threshold.

10 Claims, 6 Drawing Sheets

(52) U.S. Cl.
CPC ..... *F25B 2400/073* (2013.01); *F25B 2500/12* (2013.01); *F25B 2700/2106* (2013.01); *F25B 2700/2117* (2013.01)

(56) References Cited

U.S. PATENT DOCUMENTS

| | | | | |
|---|---|---|---|---|
| 2011/0154839 | A1* | 6/2011 | Mihara | F25B 9/008 62/151 |
| 2013/0167565 | A1* | 7/2013 | Kim | F25D 29/00 62/89 |
| 2015/0315008 | A1* | 11/2015 | Locke | B67D 1/0888 222/52 |

FOREIGN PATENT DOCUMENTS

| | | | |
|---|---|---|---|
| CN | 105258449 | A | 1/2016 |
| JP | H10-185395 | A | 7/1998 |
| KR | 10-2014-0144020 | A | 12/2014 |

* cited by examiner

REFRIGERATOR ADOPTING LINEAR COMPRESSOR AND CONTROL METHOD THEREOF

CROSS REFERENCE TO RELATED APPLICATIONS

The present application is a 35 U.S.C. § 371 National Phase conversion of International (PCT) Patent Application No. PCT/CN2016/086175, filed on Jun. 17, 2016, which further claims benefit of Chinese Patent Application No. 201510751457.0, filed on Nov. 5, 2015, the disclosure of which is incorporated by reference herein. The PCT International Patent Application was filed and published in Chinese.

TECHNICAL FIELD

The present invention relates to the technical field of refrigerator noise reduction, and in particular to a refrigerator adopting a linear compressor and a control method thereof.

BACKGROUND

Linear compressors are more and more widely applied in refrigerator manufacture industries owing to their advantages of small volume, self-lubrication and high precision.

Refrigerators rely on linear compressors to work to compress the coolant to make cooling, during which the linear compressors will generate operation noise, especially when the refrigerator has a heavy heating load. For example, at the initial power-up period of the refrigerator, a large amount of high-temperature goods is placed in the refrigerator compartments or the door of the refrigerator has been opened for a long time, the operation noise of the linear compressor is especially obvious.

The linear compressor having loud operation noise when the refrigerator has a heavy heating load is decided by the operation property of the linear compressor. When the refrigerator has a heavy heating load, the temperature of the evaporator in the cooling loop of the linear compressor will be relatively high, and the inlet and outlet pressures of the linear compressor are also relatively high. As the inlet and outlet pressures of the linear compressor are proportional to the entire vibration frequency of the linear compressor, with the increase of the heating load of the refrigerator, the vibration frequency when the linear compressor operates will also be relatively high, easy to resonate with the refrigerator body and will generate relatively loud noise.

Especially, the linear compressor has the feature of self-lubrication and does not need to connect the lubrication oil loop. In order to expand the volume of the freezing compartment at the lower portion of the refrigerator as much as possible, usually, the linear compressor is provided at the back of the refrigeration compartment at the top of the refrigerator, and the top of the refrigerator is closer to the ear when a user stands nearby. When the linear compressor operates, the noise is especially obvious, and a refrigerator adopting a linear compressor and a control method thereof are needed urgently to reduce the refrigerator noise.

SUMMARY

An object of the present invention is to provide a refrigerator adopting a linear compressor and a control method thereof.

In order to realize the above invention object, the present invention adopts the following technical solution.

A control method of a refrigerator adopting a linear compressor, comprising: monitoring the temperature of an evaporator of the refrigerator; and if the current temperature of the evaporator of the refrigerator is greater than or equal to a first preset temperature threshold, then invoking a noise reduction mode to actively reduce the heat exchange amount between the evaporator and a compartment of the refrigerator until the current temperature of the evaporator of the refrigerator is smaller than or equal to a second preset temperature threshold, and invoking a cooling mode to resume the normal heat exchange between the evaporator and the compartment of the refrigerator, wherein the first preset temperature threshold is higher than the second preset temperature threshold.

As a further improved technical solution of the present invention, the noise reduction mode comprises: closing a blower of the refrigerator and/or an air door of the compartment.

As a further improved technical solution of the present invention, the method further comprises: in the noise reduction mode, controlling the linear compressor to turn on or turn off according to the temperature in the compartment of the refrigerator, dividing an ambient temperature into a plurality of consecutive intervals, setting operation parameters of the linear compressor corresponding to each interval, and operating the linear compressor according to corresponding operation parameters.

A control method of a refrigerator adopting a linear compressor, comprising: monitoring temperatures of a refrigeration evaporator and of a freezing evaporator of the refrigerator; if the current temperature of the refrigeration evaporator of the refrigerator is greater than or equal to a first preset refrigeration temperature threshold, then invoking a refrigeration noise reduction mode to actively reduce the heat exchange amount between the refrigeration evaporator and a refrigeration compartment until the current temperature of the refrigeration evaporator is smaller than or equal to a second preset refrigeration temperature threshold, and invoking a refrigeration cooling mode to resume the normal heat exchange between the refrigeration evaporator and the refrigeration compartment, wherein the first preset refrigeration temperature threshold is higher than the second preset refrigeration temperature threshold; and if the current temperature of the freezing evaporator of the refrigerator is greater than or equal to a first preset freezing temperature threshold, then invoking a freezing noise reduction mode to actively reduce the heat exchange amount between the freezing evaporator and a freezing compartment until the current temperature of the freezing evaporator is smaller than or equal to a second preset freezing temperature threshold, and invoking a freezing cooling mode to resume the normal heat exchange between the freezing evaporator and the freezing compartment, wherein the first preset freezing temperature threshold is higher than the second preset freezing temperature threshold.

As a further improved technical solution of the present invention, the refrigeration noise reduction mode comprises: closing a blower of the refrigeration compartment and/or an air door of the refrigeration compartment; and the freezing noise reduction mode comprises: closing a blower of the freezing compartment and/or an air door of the freezing compartment.

As a further improved technical solution of the present invention, the method further comprises: in the refrigeration noise reduction mode, controlling the linear compressor to turn on or turn off according to the temperature in the refrigeration compartment, dividing an ambient temperature into a plurality of consecutive intervals, setting operation parameters of the linear compressor corresponding to each interval, and operating the linear compressor according to corresponding operation parameters; and in the freezing noise reduction mode, controlling the linear compressor to turn on or turn off according to the temperature in the freezing compartment, dividing an ambient temperature into a plurality of consecutive intervals, setting operation parameters of the linear compressor corresponding to each interval, and operating the linear compressor according to corresponding operation parameters.

A refrigerator adopting a linear compressor, comprising: an evaporator temperature sensor configured for monitoring the temperature of an evaporator of the refrigerator; and a computer board configured for controlling the operation mode of the refrigerator; and if the current temperature of the evaporator of the refrigerator is greater than or equal to a first preset temperature threshold, then invoking a noise reduction mode to actively reduce the heat exchange amount between the evaporator and a compartment of the refrigerator until the current temperature of the evaporator of the refrigerator is smaller than or equal to a second preset temperature threshold, and invoking a cooling mode to resume the normal heat exchange between the evaporator and the compartment of the refrigerator, wherein the first preset temperature threshold is higher than the second preset temperature threshold.

As a further improved technical solution of the present invention, the noise reduction mode comprises: closing a blower of the refrigerator and/or an air door of the compartment.

As a further improved technical solution of the present invention, the refrigerator further comprises: a temperature sensor inside the refrigerator compartment configured for collecting the temperature in the refrigerator compartment; a temperature sensor outside the refrigerator compartment configured for collecting an ambient temperature; and in the noise reduction mode, controlling the linear compressor to turn on or turn off according to the temperature in the compartment of the refrigerator, dividing an ambient temperature into a plurality of consecutive intervals, setting operation parameters of the linear compressor corresponding to each interval, and operating the linear compressor according to corresponding operation parameters.

A refrigerator adopting a linear compressor, comprising: a refrigeration evaporator temperature sensor configured for monitoring the temperature of a refrigeration evaporator of the refrigerator; and a freezing evaporator temperature sensor configured for monitoring the temperature of a freezing evaporator of the refrigerator; a computer board configured for: controlling the operation mode of the refrigerator; if the current temperature of the refrigeration evaporator of the refrigerator is greater than or equal to a first preset refrigeration temperature threshold, then invoking a refrigeration noise reduction mode to actively reduce the heat exchange amount between the refrigeration evaporator and a refrigeration compartment until the current temperature of the refrigeration evaporator is smaller than or equal to a second preset refrigeration temperature threshold, and invoking a refrigeration cooling mode to resume the normal heat exchange between the refrigeration evaporator and the refrigeration compartment, wherein the first preset refrigeration temperature threshold is higher than the second preset refrigeration temperature threshold; and if the current temperature of the freezing evaporator of the refrigerator is greater than or equal to a first preset freezing temperature threshold, then invoking a freezing noise reduction mode to actively reduce the heat exchange amount between the freezing evaporator and a freezing compartment until the current temperature of the freezing evaporator is smaller than or equal to a second preset freezing temperature threshold, and invoking a freezing cooling mode to resume the normal heat exchange between the freezing evaporator and the freezing compartment, wherein the first preset freezing temperature threshold is higher than the second preset freezing temperature threshold.

As a further improved technical solution of the present invention, the refrigeration noise reduction mode comprises: closing a blower of the refrigeration compartment and/or an air door of the refrigeration compartment; and the freezing noise reduction mode comprises: closing a blower of the freezing compartment and/or an air door of the freezing compartment.

As a further improved technical solution of the present invention, the refrigerator further comprises: a refrigeration compartment temperature sensor configured for collecting the temperature in the refrigerator compartment; a freezing compartment temperature sensor configured for collecting the temperature in the freezing compartment; a temperature sensor outside the refrigerator compartment configured for collecting an ambient temperature; and in the refrigeration noise reduction mode, controlling the linear compressor to turn on or turn off according to the temperature in the refrigeration compartment, dividing an ambient temperature into a plurality of consecutive intervals, setting operation parameters of the linear compressor corresponding to each interval, and operating the linear compressor according to corresponding operation parameters; and in the freezing noise reduction mode, controlling the linear compressor to turn on or turn off according to the temperature in the freezing compartment, dividing an ambient temperature into a plurality of consecutive intervals, setting operation parameters of the linear compressor corresponding to each interval, and operating the linear compressor according to corresponding operation parameters.

Compared to the prior art, the technical effects of the present invention are as follows: by means of the refrigerator adopting a linear compressor and the control method thereof in the present invention, when there is a heavy heating load, the air door of the evaporator and/or the blower is closed so that the heat exchange rate of the evaporator decreases, the temperature of the evaporator decreases rapidly, and the inlet and outlet pressures of the linear compressor also decrease accordingly. Finally, the entire vibration frequency of the linear compressor decreases, and is not easy to resonate with the refrigerator body, achieving the advantage of low operation noise.

DETAILED DESCRIPTION

Figure 1:
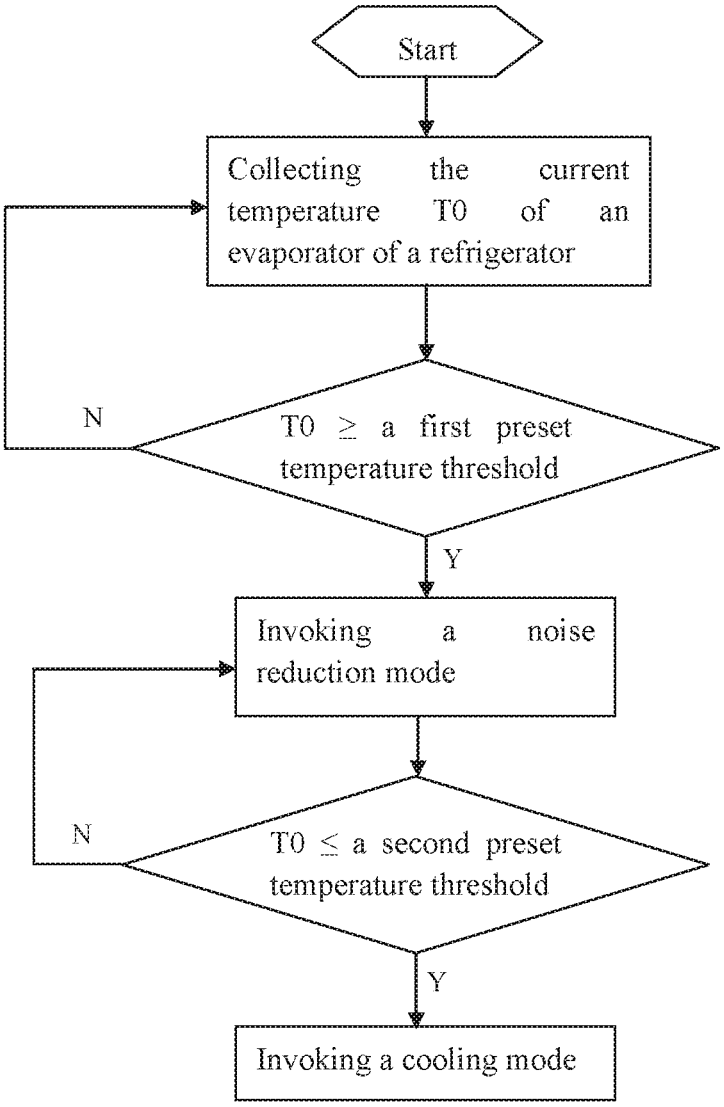
FIG. 1 is a flowchart of a control method of a refrigerator adopting a linear compressor in embodiment 1.

Hereinafter, the present invention will be described in detail in combination with the particular embodiments shown in the accompanying drawings. However, these embodiments do not limit the present invention, and the structure, method or function modifications made by those skilled in the art according to these embodiments are all contained in the protection scope of the present invention.

The same or similar components in various embodiments employ the same reference numerals.

Embodiment 1

A single-system refrigerator merely has one cooling loop. The refrigerator compartments (refrigeration compartment and freezing compartment) share one evaporator. The air inside the refrigerator compartments is forced to pass through the evaporator using a blower and return to the refrigerator compartments after being cooled to form a forced circulation of the cool air in the refrigerator compartments.

Figure 5:
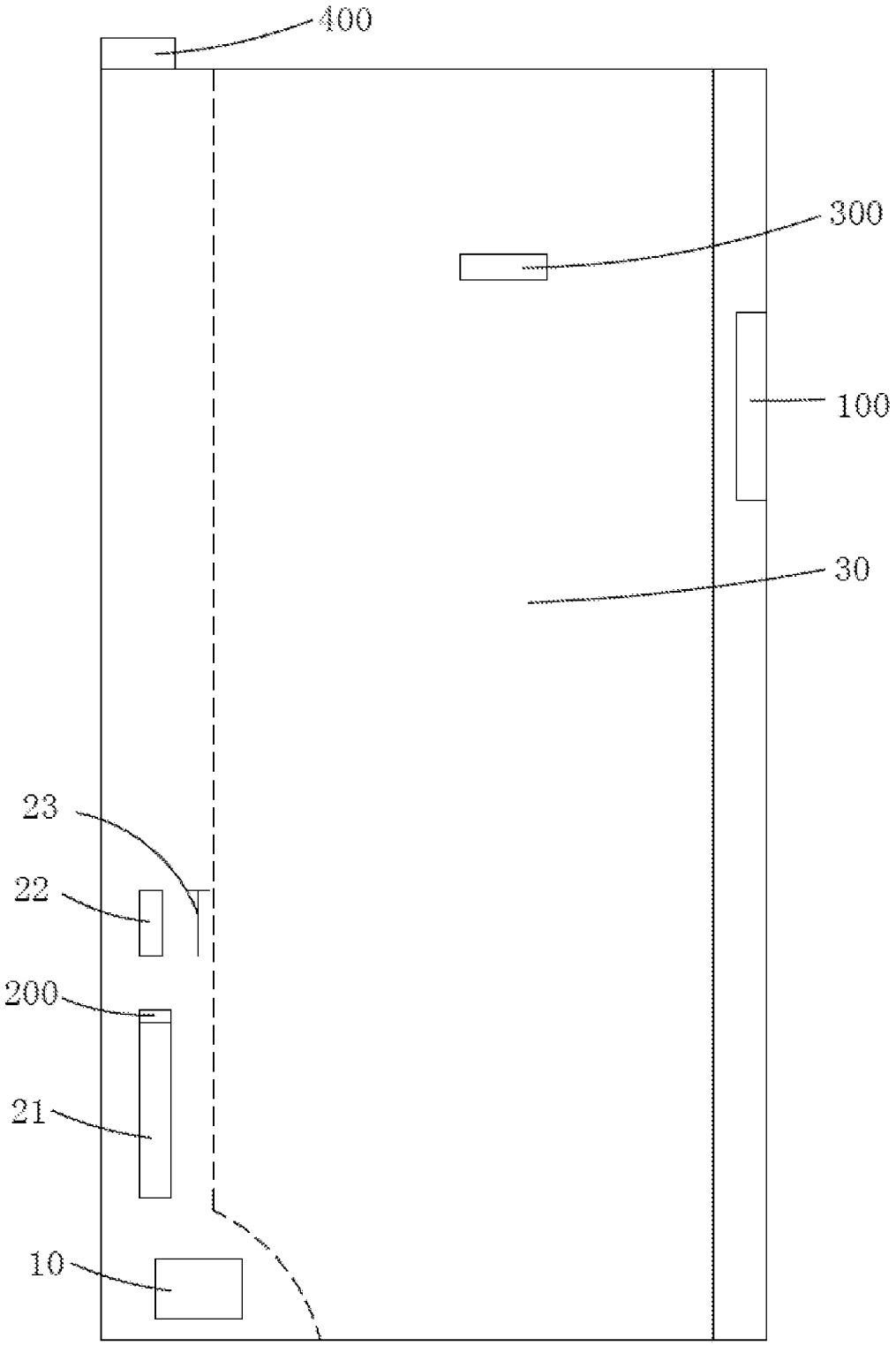
FIG. 5 is a schematic side view of a refrigerator adopting a linear component in accordance with embodiment 1 of the present invention.

Referring to FIG. 1 and FIG. 5, for a single-system air-cooled refrigerator, the present invention discloses a control method of a refrigerator adopting a linear compressor 10, comprising: monitoring the temperature of an evaporator 21 of the refrigerator; and if the current temperature of the refrigerator evaporator is greater than or equal to a first preset temperature threshold, then invoking the noise reduction mode to actively reduce the heat exchange amount between the evaporator and the refrigerator compartments 30, and further, in the noise reduction mode, reducing the heat exchange amount between the evaporator and the refrigerator compartments 30 by closing the blower 22 of the refrigerator and/or the air doors 23 of the compartments 30.

It should be understood that when the blower and/or the air doors of the compartments are closed, the forced convection between the air in the refrigerator compartments and the evaporator is blocked, the cooling amount loss of the evaporator will become small, the temperature can decrease rapidly, the inlet and outlet pressures of the linear compressor will decrease, and the operation noise will decrease.

When the current temperature of the refrigerator evaporator is less than or equal to a second preset temperature threshold, a cooling mode will be invoked to resume the normal heat exchange between the evaporator and the refrigerator compartments, and further, in the cooling mode, the blower and the air door are controlled to operate according to the temperature in the refrigerator compartments and the ambient temperature.

In particular, the temperature in the refrigerator compartments can be used for controlling the turning-on or turning-off of the blower and the opening and closing of the air doors of the compartments. The ambient temperature can be divided into a plurality of consecutive intervals. The operating rotation speed of the blower is set corresponding to each temperature interval. For example, when the ambient temperature is 10-20 degrees, the operating rotation speed of the blower is 500 revolutions per minute; when the ambient temperature is 20-30 degrees, the operating rotation speed of the blower is 700 revolutions per minute; and when the current temperature of the refrigerator evaporator is less than or equal to a second preset temperature threshold, the blower and the air doors of the compartments operate according to corresponding operation parameters.

The first preset temperature threshold is higher than the second preset temperature threshold. In particular, the vibration spectrum when the refrigerator operates is scanned and the temperature of the evaporator when the refrigerator resonates is recorded. This temperature is the first preset temperature threshold. The second preset temperature threshold is slightly smaller than the first preset temperature threshold, for preventing the refrigerator switching frequently between the noise reduction mode and the cooling mode.

Furthermore, the method further includes: in the noise reduction mode, controlling the operation of the linear compressor according to the temperature in the refrigerator compartments and the ambient temperature. In particular, the temperature in the refrigerator compartments can be used for controlling the turning-on or turning-off of the linear compressor. The ambient temperature can be divided into a plurality of consecutive intervals. The operating parameters of the linear compressor are set corresponding to each interval. For example, when the ambient temperature is 10-20 degrees, the input frequency of the linear compressor is 100 W; when the ambient temperature is 20-30 degrees, the input frequency of the linear compressor is 120 W. When the current temperature of the refrigerator evaporator is greater than or equal to a first preset temperature, the linear compressor operates according to corresponding operation parameters.

In the conventional control logic of the air-cooled refrigerator, the operation state of the linear compressor and the operation states of the blower and the air doors of the compartments are correlated. It should be understood that if the travel of the linear compressor (the travel is proportional to the input frequency) gradually declines along with the closing of the blower and/or the air doors of the compartments in the noise reduction mode, then the declination trend of the temperature of the evaporator slows down. Thus, it is preferred that the linear compressor is controlled to operate according to the temperature in the refrigerator compartments and the ambient temperature so as to ensure that the evaporator temperature can decrease rapidly.

Figure 2:
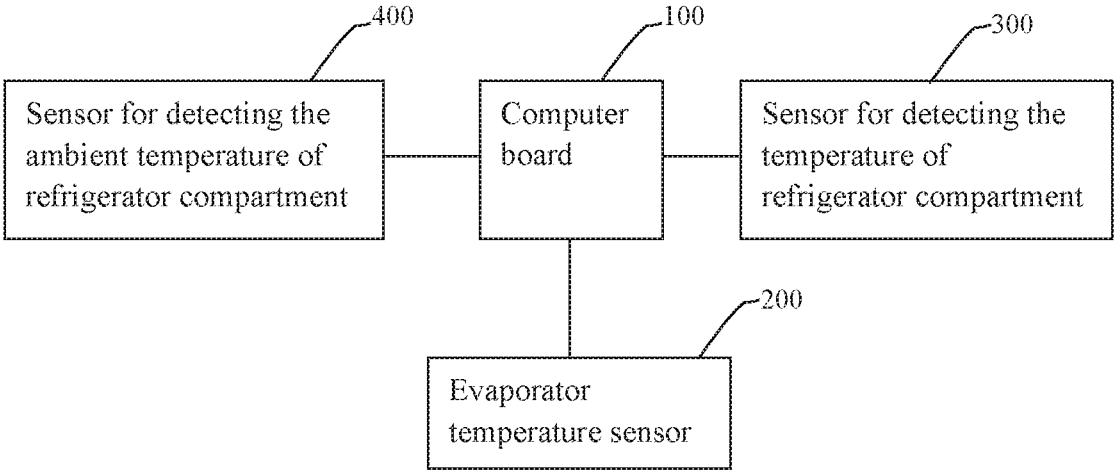
FIG. 2 is a block diagram of a refrigerator adopting a linear compressor in embodiment 1.

Referring to FIG. 2 and FIG. 5, the present invention also discloses a refrigerator adopting a linear compressor, comprising: an evaporator temperature sensor 200 configured for monitoring the temperature of an evaporator of the refrigerator; a computer board 100 configured for controlling the operation mode of the refrigerator; a temperature sensor inside the refrigerator compartment 300 configured for collecting the temperature in the refrigeration compartment; and a temperature sensor outside the refrigerator compartment 400 configured for collecting an ambient temperature.

If the current temperature of the refrigerator evaporator is greater than or equal to a first preset temperature threshold, then the noise reduction mode will be invoked to actively reduce the heat exchange amount between the evaporator and the refrigerator compartments; and further, in the noise reduction mode, the heat exchange amount between the evaporator and the refrigerator compartments is reduced by closing the blower of the refrigerator and/or the air doors of the compartments.

It should be understood that when the blower and/or the air doors of the compartments are closed, the forced convection between the air in the refrigerator compartments and the evaporator is blocked, the cooling amount loss of the evaporator will become small, the temperature can decrease rapidly, the inlet and outlet pressures of the linear compressor will decrease, and the operation noise will decrease.

When the current temperature of the refrigerator evaporator is less than or equal to a second preset temperature threshold, a cooling mode will be invoked to resume the normal heat exchange between the evaporator and the refrigerator compartments; and further, in the cooling mode, the blower and the air door are controlled to operate according to the temperature in the refrigerator compartments and the ambient temperature.

In particular, the temperature in the refrigerator compartments can be used for controlling the turning-on or turning-off of the blower and the opening and closing of the air doors of the compartments. The ambient temperature can be divided into a plurality of consecutive intervals. The operating rotation speed of the blower is set corresponding to each temperature interval. For example, when the ambient temperature is 10-20 degrees, the operating rotation speed of the blower is 500 revolutions per minute; when the ambient temperature is 20-30 degrees, the operating rotation speed of the blower is 700 revolutions per minute; and when the current temperature of the refrigerator evaporator is less than or equal to a second preset temperature, the blower and the air doors of the compartments operate according to corresponding operation parameters.

The first preset temperature threshold is higher than the second preset temperature threshold. In particular, the vibration spectrum when the refrigerator operates is scanned and the temperature of the evaporator when the refrigerator resonates is recorded. This temperature is the first preset temperature threshold. The second preset temperature threshold is slightly smaller than the first preset temperature threshold, for preventing the refrigerator switching frequently between the noise reduction mode and the cooling mode.

In the noise reduction mode, the operation of the linear compressor is controlled according to the temperature in the refrigerator compartments and the ambient temperature. In particular, the temperature in the refrigerator compartments can be used for controlling the turning-on or turning-off of the linear compressor. The ambient temperature can be divided into a plurality of consecutive intervals. The operating parameters of the linear compressor are set corresponding to each interval. For example, when the ambient temperature is 10-20 degrees, the input frequency of the linear compressor is 100 W; when the ambient temperature is 20-30 degrees, the input frequency of the linear compressor is 120 W. When the current temperature of the refrigerator evaporator is greater than or equal to a first preset temperature, the linear compressor operates according to corresponding operation parameters.

In the conventional control logic of the air-cooled refrigerator, the operation state of the linear compressor and the operation states of the blower and the air doors of the compartments are correlated. It should be understood that if the travel of the linear compressor (the travel is proportional to the input frequency) gradually declines along with the closing of the blower and/or the air doors of the compartments in the noise reduction mode, then the declination trend of the temperature of the evaporator slows down. Thus, it is preferred that the linear compressor is controlled to operate according to the temperature in the refrigerator compartments and the ambient temperature so as to ensure that the evaporator temperature can decrease rapidly.

When there is a heavy heating load, the air door of the evaporator and/or the blower is closed so that the heat exchange rate of the evaporator decreases, the temperature of the evaporator decreases rapidly, and the inlet and outlet pressures of the linear compressor also decrease accordingly. Finally, the entire vibration frequency of the linear compressor decreases, and is not easy to resonate with the refrigerator body, achieving the advantage of low operation noise.

Embodiment 2

A multi-system refrigerator has a refrigeration compartment cooling loop and a freezing compartment cooling loop. The refrigeration compartment and the freezing compartment respectively have a corresponding evaporator and blower. When the coolant passes through the refrigeration loop, the refrigeration compartment blower is adopted to force the air in the refrigeration compartment to pass through the refrigeration evaporator and return to the refrigeration compartment after being cooled to form a forced circulation of the cool air in the refrigeration compartment. Accordingly, when the coolant passes through the freezing loop, the freezing compartment blower is adopted to force the air in the freezing compartment to pass through the freezing evaporator and return to the freezing compartment after being cooled to form a forced circulation of the cool air in the freezing compartment.

Figure 3:
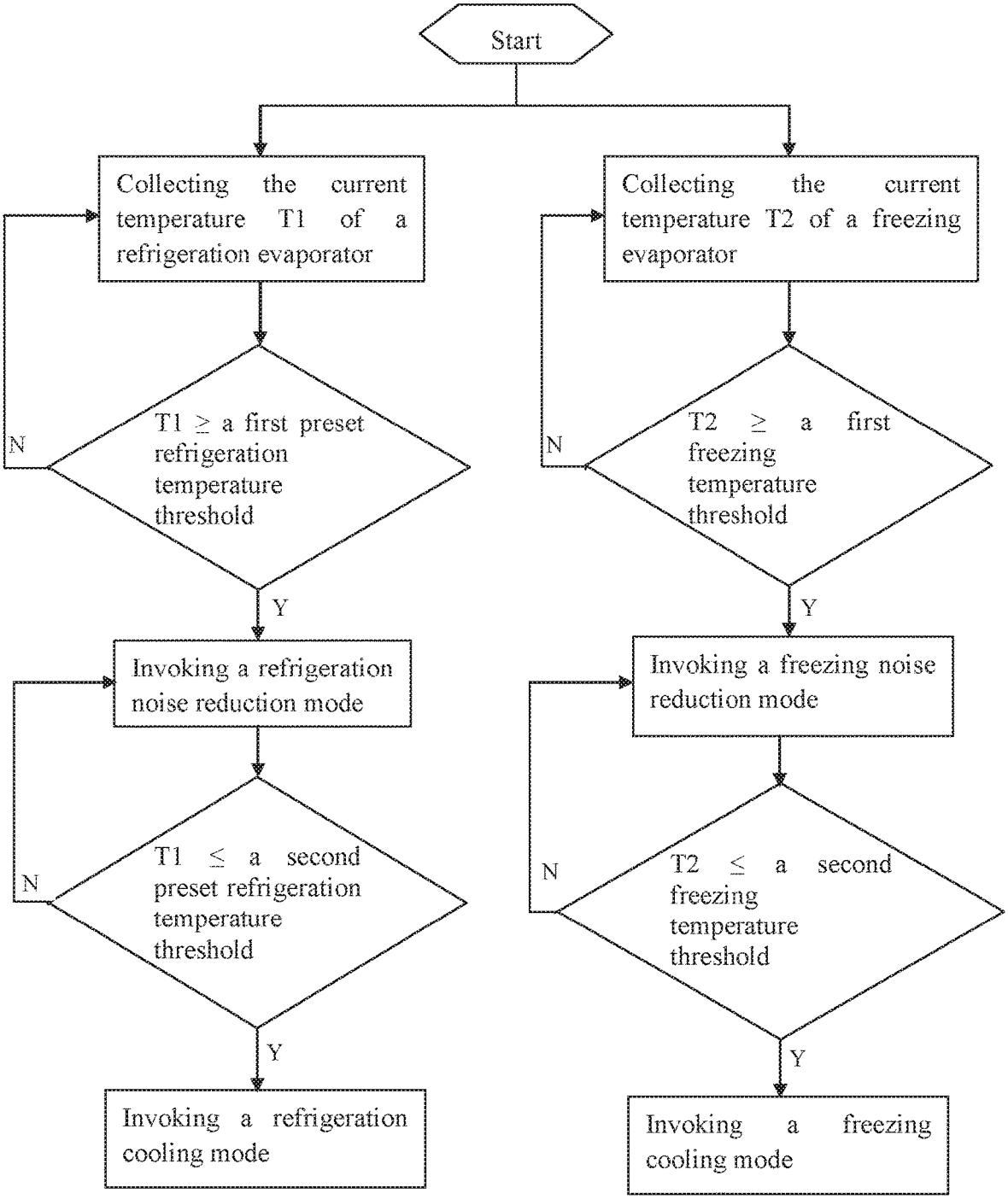
FIG. 3 is a flowchart of a control method of a refrigerator adopting a linear compressor in embodiment 2.
Figure 6:
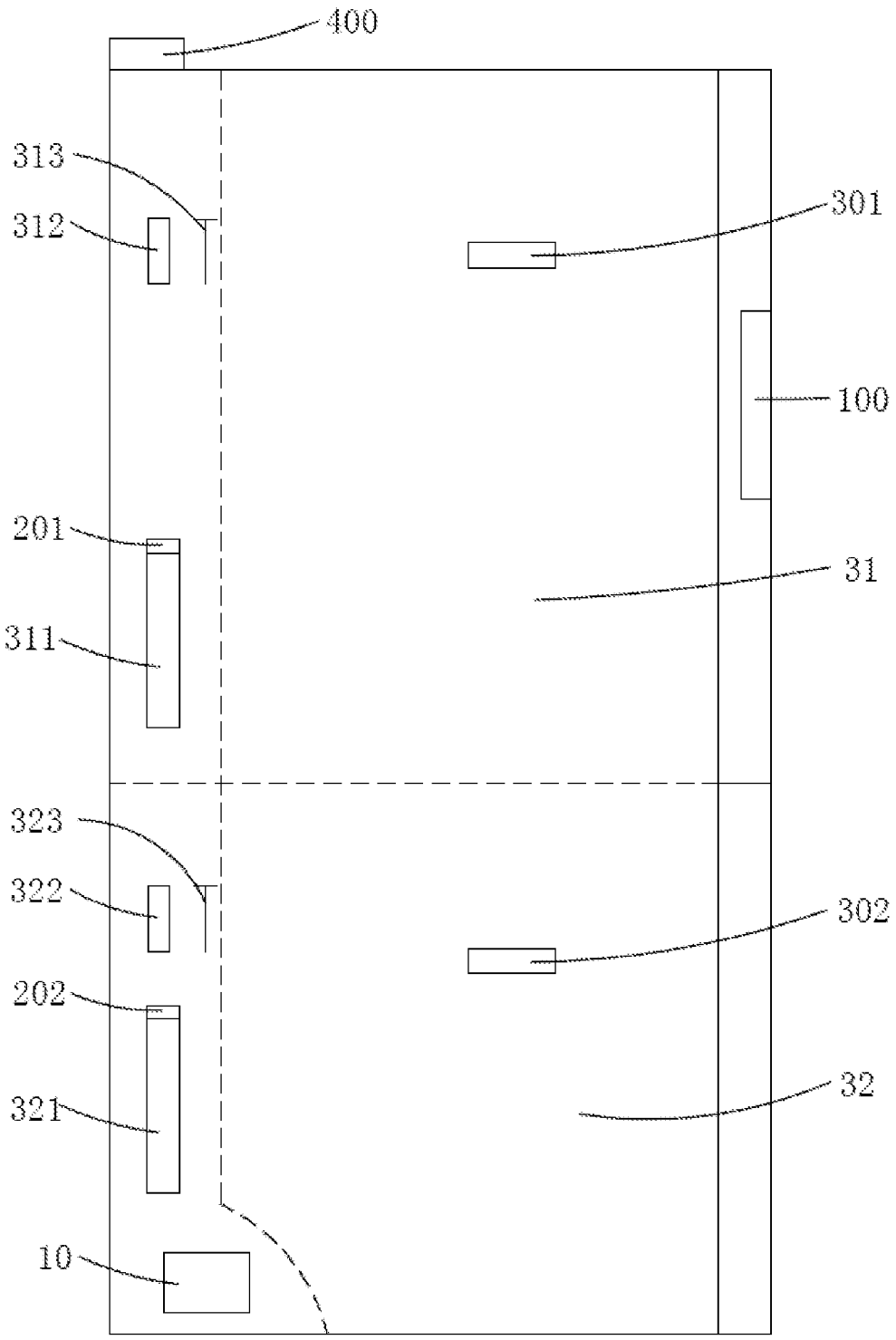
FIG. 6 is a schematic side view of a refrigerator adopting a linear component in accordance with embodiment 2 of the present invention.

Referring to FIG. 3 and FIG. 6, for a multi-system air-cooled refrigerator, the present invention discloses a control method of a refrigerator adopting a linear compressor 10, comprising: monitoring temperatures of a refrigeration evaporator 311 and of a freezing evaporator 321 of the refrigerator; if the current temperature of the refrigerator refrigeration evaporator is greater than or equal to a first preset refrigeration temperature threshold, then invoking the refrigeration noise reduction mode to actively reduce the heat exchange amount between the refrigeration evaporator 311 and the refrigeration compartment 31; and further, in the refrigeration noise reduction mode, reducing the heat exchange amount between the refrigeration evaporator 311 and the refrigeration compartment 31 by closing a blower 312 of the refrigeration compartment 31 and/or an air door 313 of the refrigeration compartment 31.

The method also comprises: if the current temperature of the refrigerator freezing evaporator 321 is greater than or equal to a first preset freezing temperature threshold, then invoking the freezing noise reduction mode to actively reduce the heat exchange amount between the freezing evaporator 321 and the freezing compartment 32; and further, in the freezing noise reduction mode, reducing the heat exchange amount between the freezing evaporator 321 and the freezing compartment 32 by closing a blower 322 of the freezing compartment 32 and/or an air door 323 of the freezing compartment 32.

It should be understood that when the blower of the refrigeration compartment and/or the air door of the refrigeration compartment is closed, the forced convection of the air in the refrigeration compartment and the refrigeration evaporator is blocked, the cooling amount loss of the refrigeration evaporator will become small, the temperature can decrease rapidly, the inlet and outlet pressures of the linear compressor when the coolant passes through the refrigeration loop will decrease, and the operation noise will decrease; and when the blower of the freezing compartment and/or the air door of the freezing compartment is closed, the forced convection between the air in the freezing compartment and the freezing evaporator is blocked, the cooling amount loss of the freezing evaporator will become small, the temperature can decrease rapidly, the inlet and outlet pressures of the linear compressor when the coolant passes through the freezing loop will decrease, and the operation noise will decrease.

When the current temperature of the refrigeration evaporator is less than or equal to a second preset refrigeration temperature threshold, a refrigeration cooling mode will be invoked to resume the normal heat exchange between the refrigeration evaporator and the refrigeration compartment. Further, the blower of the refrigeration compartment and the air door of the refrigeration compartment are controlled to operate according to the temperature in the refrigeration compartment and the ambient temperature in the refrigeration cooling mode.

In particular, the temperature in the refrigeration compartment can be used for controlling the turning-on or turning-off of the blower of the refrigeration compartment and the opening and closing of the air door of the refrigeration compartment. The ambient temperature can be divided into a plurality of consecutive intervals. The operating rotation speed of the blower of the refrigeration compartment is set corresponding to each temperature interval. For example, when the ambient temperature is 10-20 degrees, the operating rotation speed of the blower of the refrigeration compartment is 500 revolutions per minute; when the ambient temperature is 20-30 degrees, the operating rotation speed of the blower of the refrigeration compartment is 700 revolutions per minute; and when the current temperature of the refrigeration evaporator is less than or equal to a second preset refrigeration temperature threshold, the blower and the air door of the refrigeration compartment operate according to corresponding operation parameters.

When the current temperature of the freezing evaporator is less than or equal to a second preset freezing temperature threshold, a freezing cooling mode will be invoked to resume the normal heat exchange between the freezing evaporator and the freezing compartment. Further, in the freezing cooling mode, the blower of the freezing compartment and the air door of the freezing compartment are controlled to operate according to the temperature in the freezing compartment and the ambient temperature.

In particular, the temperature in the freezing compartment can be used for controlling the turning-on or turning-off of the blower of the freezing compartment and the opening and closing of the air door of the freezing compartment. The ambient temperature can be divided into a plurality of consecutive intervals. The operating rotation speed of the blower of the freezing compartment is set corresponding to each temperature interval. For example, when the ambient temperature is 10-20 degrees, the operating rotation speed of the blower of the freezing compartment is 500 revolutions per minute; when the ambient temperature is 20-30 degrees, the operating rotation speed of the blower of the freezing compartment is 700 revolutions per minute; and when the current temperature of the freezing evaporator is less than or equal to a second preset freezing temperature threshold, the blower and the air door of the freezing compartment operate according to corresponding operation parameters.

The first preset refrigeration temperature threshold is higher than the second preset refrigeration temperature threshold. The first preset freezing temperature threshold is higher than the second preset freezing temperature threshold. In particular, the vibration spectrum of the refrigerator when the coolant passes through the refrigeration loop and the freezing loop is scanned respectively and the temperatures of the refrigeration evaporator and the freezing evaporator when the refrigerator resonates are recorded respectively. The above temperatures are the first preset refrigeration temperature threshold and the first preset freezing temperature threshold. The second preset refrigeration temperature threshold is slightly smaller than the first preset refrigeration temperature threshold, for preventing the refrigerator switching frequently between the refrigeration noise reduction mode and the refrigeration cooling mode. The second preset freezing temperature threshold is slightly smaller than the first preset freezing temperature threshold, for preventing the refrigerator switching frequently between the freezing noise reduction mode and the freezing cooling mode.

Furthermore, the method further includes: in the refrigeration noise reduction mode, controlling the operation of the linear compressor according to the temperature in the refrigeration compartment and the ambient temperature, wherein in particular, when the coolant passes through the refrigeration loop, the temperature in the refrigeration compartment can be used for controlling the turning-on or turning-off of the linear compressor, the ambient temperature can be divided into a plurality of consecutive intervals, and the operating parameters of the linear compressor are set corresponding to each interval. For example, when the ambient temperature is 10-20 degrees, the input frequency of the linear compressor is 100 W; when the ambient temperature is 20-30 degrees, the input frequency of the linear compressor is 120 W. When the current temperature of the refrigeration evaporator is greater than or equal to a first preset refrigeration temperature threshold, the linear compressor operates according to corresponding operation parameters.

The method further includes: in the freezing noise reduction mode, controlling the operation of the linear compressor according to the temperature in the freezing compartment and the ambient temperature, wherein in particular, when the coolant passes through the freezing loop, the temperature in the freezing compartment can be used for controlling the turning-on or turning-off of the linear compressor, the ambient temperature can be divided into a plurality of consecutive intervals, and the operating parameters of the linear compressor are set corresponding to each interval. For example, when the ambient temperature is 10-20 degrees, the input frequency of the linear compressor is 100 W; when the ambient temperature is 20-30 degrees, the input frequency of the linear compressor is 120 W. When the current temperature of the freezing evaporator is greater than or equal to a first preset freezing temperature threshold, the linear compressor operates according to corresponding operation parameters.

Figure 4:
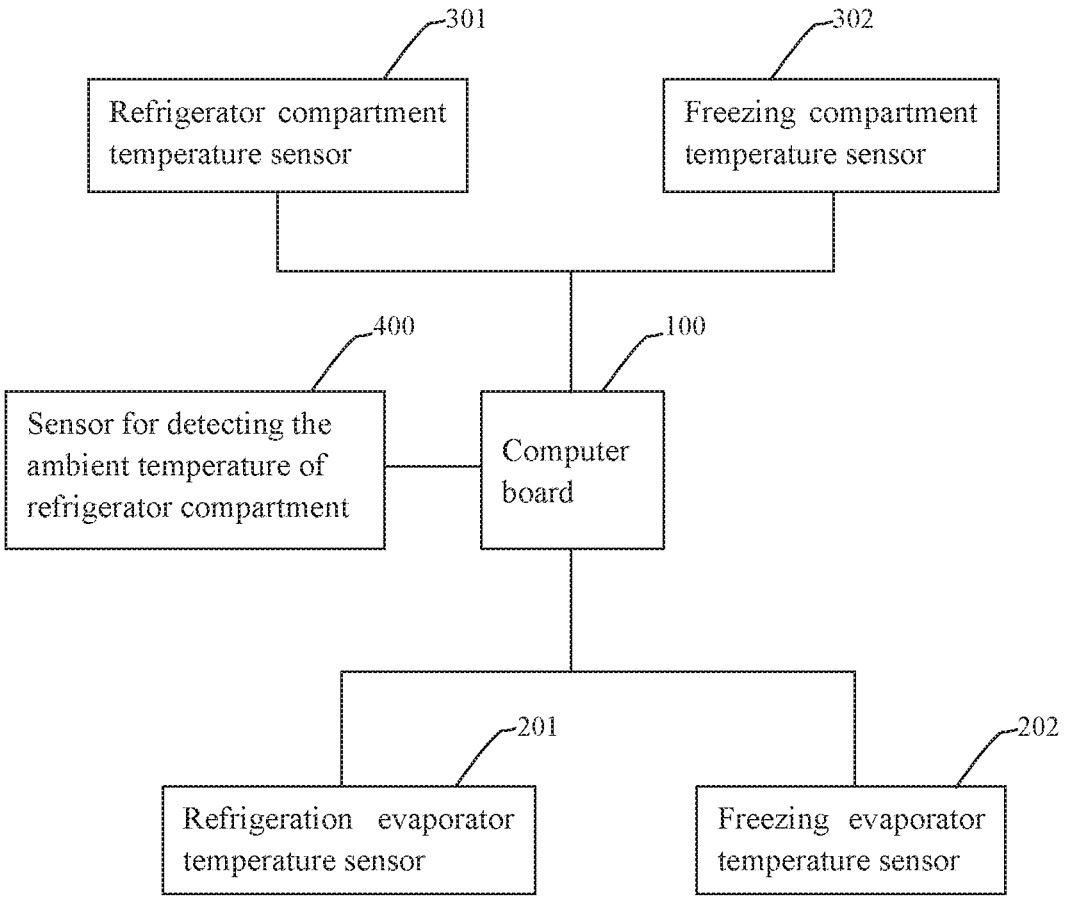
FIG. 4 is a block diagram of a refrigerator adopting a linear compressor in embodiment 2.

In the conventional control logic of the air-cooled refrigerator, the operation state of the linear compressor and the operation states of the blower of the refrigeration compartment, the blower of the freezing machine, the air door of the refrigeration compartment and the air door of the freezing compartment are correlated. It should be understood that if the travel of the linear compressor (the travel is proportional to the input frequency) gradually declines along with the closing of the blower of the refrigeration compartment and the air door of the refrigeration compartment in the refrigeration noise reduction mode. Then the declination trend of the temperature in the refrigeration evaporator slows down. Thus, it is preferred that the linear compressor is controlled to operate according to the temperature in the refrigeration compartment and the ambient temperature in the refrigeration noise reduction mode so as to ensure that the refrigeration evaporator temperature can decrease rapidly. If the travel of the linear compressor (the travel is proportional to the input frequency) gradually declines along with the closing of the blower of the freezing compartment and the air door of the freezing compartment in the freezing noise reduction mode, then the declination trend of the temperature in the freezing evaporator slows down. Thus, it is preferred that the linear compressor is controlled to operate according to the temperature in the freezing compartment and the ambient temperature in the freezing noise reduction mode so as to ensure that the freezing evaporator temperature can decrease rapidly Referring to FIG. 4 and FIG. 6, the present invention also discloses a refrigerator adopting a linear compressor, comprising: a refrigeration evaporator temperature sensor 201 configured for monitoring the temperature of a refrigeration evaporator of the refrigerator; a freezing evaporator temperature sensor 202 configured for monitoring the temperature of a freezing evaporator of the refrigerator; a computer board 100 configured for controlling the operation mode of the refrigerator; a refrigeration compartment temperature sensor 301 configured for collecting the temperature in the refrigeration compartment; a freezing compartment temperature sensor 302 configured for collecting the temperature in the freezing compartment; and a temperature sensor outside the refrigerator compartment 400 configured for collecting an ambient temperature.

If the current temperature of the refrigerator refrigeration evaporator is greater than or equal to a first preset refrigeration temperature threshold, then the refrigeration noise reduction mode is invoked to actively reduce the heat exchange amount between the refrigeration evaporator and the refrigeration compartment. Further, in the refrigeration noise reduction mode, the heat exchange amount between the refrigeration evaporator and the refrigeration compartment is reduced by closing a blower of the refrigeration compartment and/or an air door of the refrigeration compartment.

If the current temperature of the refrigerator freezing evaporator is greater than or equal to a first preset freezing temperature threshold, then the freezing noise reduction mode is invoked to actively reduce the heat exchange amount between the freezing evaporator and the freezing compartment. Further, in the freezing noise reduction mode, the heat exchange amount between the freezing evaporator and the freezing compartment is reduced by closing a blower of the freezing compartment and/or an air door of the freezing compartment.

It should be understood that when the blower of the refrigeration compartment and/or the air door of the refrigeration compartment is closed, the forced convection of the air in the refrigeration compartment and the refrigeration evaporator is blocked, the cooling amount loss of the refrigeration evaporator will become small, the temperature can decrease rapidly, the inlet and outlet pressures of the linear compressor when the coolant passes through the refrigeration loop will decrease, and the operation noise will decrease. When the blower of the freezing compartment and/or the air door of the freezing compartment is closed, the forced convection between the air in the freezing compartment and the freezing evaporator is blocked, the cooling amount loss of the freezing evaporator will become small, the temperature can decrease rapidly, the inlet and outlet pressures of the linear compressor when the coolant passes through the freezing loop will decrease, and the operation noise will decrease.

When the current temperature of the refrigeration evaporator is less than or equal to a second preset refrigeration temperature threshold, a refrigeration cooling mode will be invoked to resume the normal heat exchange between the refrigeration evaporator and the refrigeration compartment. Further, in the refrigeration cooling mode, the blower of the refrigeration compartment and the air door of the refrigeration compartment are controlled to operate according to the temperature in the refrigeration compartment and the ambient temperature.

In particular, the temperature in the refrigeration compartment can be used for controlling the turning-on or turning-off of the blower of the refrigeration compartment and the opening and closing of the air door of the refrigeration compartment. The ambient temperature can be divided into a plurality of consecutive intervals. The operating rotation speed of the blower of the refrigeration compartment is set corresponding to each temperature interval. For example, when the ambient temperature is 10-20 degrees, the operating rotation speed of the blower of the refrigeration compartment is 500 revolutions per minute. When the ambient temperature is 20-30 degrees, the operating rotation speed of the blower of the refrigeration compartment is 700 revolutions per minute. When the current temperature of the refrigeration evaporator is less than or equal to a second preset refrigeration temperature threshold, the blower and the air door of the refrigeration compartment operate according to corresponding operation parameters.

When the current temperature of the freezing evaporator is less than or equal to a second preset freezing temperature threshold, a freezing cooling mode will be invoked to resume the normal heat exchange between the freezing evaporator and the freezing compartment. Further, in the freezing cooling mode, the blower of the freezing compartment and the air door of the freezing compartment are controlled to operate according to the temperature in the freezing compartment and the ambient temperature.

In particular, the temperature in the freezing compartment can be used for controlling the turning-on or turning-off of the blower of the freezing compartment and the opening and closing of the air door of the freezing compartment. The ambient temperature can be divided into a plurality of consecutive intervals. The operating rotation speed of the blower of the freezing compartment is set corresponding to each temperature interval. For example, when the ambient temperature is 10-20 degrees, the operating rotation speed of the blower of the freezing compartment is 500 revolutions per minute; when the ambient temperature is 20-30 degrees, the operating rotation speed of the blower of the freezing compartment is 700 revolutions per minute. When the current temperature of the freezing evaporator is less than or equal to the second preset freezing temperature threshold, the blower and the air door of the freezing compartment operate according to corresponding operation parameters.

The first preset refrigeration temperature threshold is higher than the second preset refrigeration temperature threshold. The first preset freezing temperature threshold is higher than the second preset freezing temperature threshold. In particular, the vibration spectrum of the refrigerator when the coolant passes through the refrigeration loop and the freezing loop is scanned respectively and the temperatures of the refrigeration evaporator and the freezing evaporator when the refrigerator resonates are recorded respectively. The above temperatures are the first preset refrigeration temperature threshold and the first preset freezing temperature threshold. The second preset refrigeration temperature threshold is slightly smaller than the first preset refrigeration temperature threshold, for preventing the refrigerator switching frequently between the refrigeration noise reduction mode and the refrigeration cooling mode. The second preset freezing temperature threshold is slightly smaller than the first preset freezing temperature threshold, for preventing the refrigerator switching frequently between the freezing noise reduction mode and the freezing cooling mode.

In the refrigeration noise reduction mode, the operation of the linear compressor is controlled according to the temperature in the refrigeration compartment and the ambient temperature. In particular, when the coolant passes through the refrigeration loop, the temperature in the refrigeration compartment can be used for controlling the turning-on or turning-off of the linear compressor. The ambient temperature can be divided into a plurality of consecutive intervals. The operating parameters of the linear compressor are set corresponding to each interval. For example, when the ambient temperature is 10-20 degrees, the input frequency of the linear compressor is 100 W. When the ambient temperature is 20-30 degrees, the input frequency of the linear compressor is 120 W. When the current temperature of the refrigeration evaporator is greater than or equal to a first preset refrigeration temperature threshold, the linear compressor operates according to corresponding operation parameters.

In the freezing noise reduction mode, the operation of the linear compressor is controlled according to the temperature in the freezing compartment and the ambient temperature. In particular, when the coolant passes through the freezing loop, the temperature in the freezing compartment can be used for controlling the turning-on or turning-off of the linear compressor. The ambient temperature can be divided into a plurality of consecutive intervals. The operating parameters of the linear compressor are set corresponding to each interval. For example, when the ambient temperature is 10-20 degrees, the input frequency of the linear compressor is 100 W. When the ambient temperature is 20-30 degrees, the input frequency of the linear compressor is 120 W. When the current temperature of the freezing evaporator is greater than or equal to a first preset freezing temperature threshold, the linear compressor operates according to corresponding operation parameters.

In the conventional control logic of the air-cooled refrigerator, the operation state of the linear compressor and the operation states of the blower of the refrigeration compartment, the blower of the freezing machine, the air door of the refrigeration compartment and the air door of the freezing compartment are correlated. It should be understood that if the travel of the linear compressor (the travel is proportional to the input frequency) gradually declines along with the closing of the blower of the refrigeration compartment and the air door of the refrigeration compartment in the refrigeration noise reduction mode. Then the declination trend of the temperature in the refrigeration evaporator slows down. Thus, it is preferred that the linear compressor is controlled to operate according to the temperature in the refrigeration compartment and the ambient temperature in the refrigeration noise reduction mode so as to ensure that the refrigeration evaporator temperature can decrease rapidly. If the travel of the linear compressor (the travel is proportional to the input frequency) gradually declines along with the closing of the blower of the freezing compartment and the air door of the freezing compartment in the freezing noise reduction mode, then the declination trend of the temperature in the freezing evaporator slows down. Thus, it is preferred that the linear compressor is controlled to operate according to the temperature in the freezing compartment and the ambient temperature in the freezing noise reduction mode so as to ensure that the freezing evaporator temperature can decrease rapidly.

When there is a heavy refrigeration compartment heating load, the air door of the refrigeration compartment and/or the blower of the refrigeration compartment are/is closed so that the heat exchange rate of the refrigeration evaporator decreases, the temperature in the refrigeration evaporator decreases rapidly. When there is a heavy freezing compartment heating load, the air door of the freezing compartment and/or the blower of the freezing compartment are/is closed so that the heat exchange rate of the freezing evaporator decreases, and the inlet and outlet pressures of the linear compressor also decrease accordingly. Finally, the entire vibration frequency of the linear compressor decreases, and is not easy to resonate with the refrigerator body, achieving the advantage of low operation noise.

At last, it should be noted that the above embodiments are merely used to describe the technical solution of the present invention rather than limiting same. Although the present invention has been described in detail with reference to the above embodiments, those skilled in the art shall understand that they can still modify the technical solution recorded in the above various embodiments or equivalently replace some technical features. The essence of these modifications or replacements of the corresponding technical solutions does not depart from the spirit and scope of the technical solution in various embodiments of the present invention.

What is claimed is:

1. A control method of a refrigerator adopting a linear compressor, comprising:

monitoring temperature of an evaporator of the refrigerator;

if a current temperature of the evaporator of the refrigerator is greater than or equal to a first preset temperature threshold, then invoking a noise reduction mode to actively reduce a heat exchange amount between the evaporator and a compartment of the refrigerator until the current temperature of the evaporator of the refrigerator is less than or equal to a second preset temperature threshold, and invoking a cooling mode to resume heat exchange between the evaporator and the compartment of the refrigerator back to the heat exchange amount before being reduced, wherein the first preset temperature threshold is higher than the second preset temperature threshold; and in the noise reduction mode, controlling the linear compressor to turn on or turn off according to the temperature in the compartment of the refrigerator, setting a plurality of consecutive temperature intervals corresponding to an ambient temperature outside the compartment, setting operation parameters of the linear compressor corresponding to each interval, and operating the linear compressor according to corresponding operation parameters.

2. The control method of a refrigerator adopting a linear compressor according to claim 1, wherein the noise reduction mode comprises:

closing a blower of the refrigerator and/or an air door of the compartment.

3. The control method of a refrigerator adopting a linear compressor according to claim 1, wherein the evaporator of the refrigerator comprises a refrigeration evaporator and a freezing evaporator, the first preset temperature threshold comprises a first preset refrigeration temperature threshold and a first preset freezing temperature threshold, the second preset temperature threshold comprises a second preset refrigeration temperature threshold and a second preset freezing temperature threshold, and the step of monitoring temperature of an evaporator of the refrigerator comprises:

monitoring temperatures of the refrigeration evaporator and of the freezing evaporator of the refrigerator;

if a current temperature of the refrigeration evaporator of the refrigerator is greater than or equal to the first preset refrigeration temperature threshold, then invoking a refrigeration noise reduction mode to actively reduce a first heat exchange amount between the refrigeration evaporator and a refrigeration compartment until the current temperature of the refrigeration evaporator is less than or equal to the second preset refrigeration temperature threshold, and invoking a refrigeration cooling mode to resume heat exchange between the refrigeration evaporator and the refrigeration compartment back to the first heat exchange amount before being reduced, wherein the first preset refrigeration temperature threshold is higher than the second preset refrigeration temperature threshold; and if a current temperature of the freezing evaporator of the refrigerator is greater than or equal to the first preset freezing temperature threshold, then invoking a freezing noise reduction mode to actively reduce a second heat exchange amount between the freezing evaporator and a freezing compartment until the current temperature of the freezing evaporator is less than or equal to the second preset freezing temperature threshold, and invoking a freezing cooling mode to resume heat exchange between the freezing evaporator and the freezing compartment back to the second heat exchange amount before being reduced, wherein the first preset freezing temperature threshold is higher than the second preset freezing temperature threshold.

4. The control method of a refrigerator adopting a linear compressor according to claim 3, wherein the refrigeration noise reduction mode comprises:

closing a blower of the refrigeration compartment and/or an air door of the refrigeration compartment; and the freezing noise reduction mode comprises:

closing a blower of the freezing compartment and/or an air door of the freezing compartment.

5. The control method of a refrigerator adopting a linear compressor according to claim 4, further comprising:

in the refrigeration noise reduction mode, controlling the linear compressor to turn on or turn off according to the temperature in the refrigeration compartment, setting a plurality of consecutive temperature intervals corresponding to an ambient temperature outside the refrigeration compartment, setting operation parameters of the linear compressor corresponding to each interval, and operating the linear compressor according to corresponding operation parameters; and in the freezing noise reduction mode, controlling the linear compressor to turn on or turn off according to the temperature in the freezing compartment, setting a plurality of consecutive temperature intervals corresponding to an ambient temperature outside the freezing compartment, setting operation parameters of the linear compressor corresponding to each interval, and operating the linear compressor according to corresponding operation parameters.

6. A refrigerator adopting a linear compressor, comprising:

an evaporator temperature sensor configured for monitoring temperature of an evaporator of the refrigerator;

a computer board configured for: controlling an operation mode of the refrigerator; if a current temperature of the evaporator of the refrigerator is greater than or equal to a first preset temperature threshold, then invoking a noise reduction mode to actively reduce a heat exchange amount between the evaporator and a compartment of the refrigerator until the current temperature of the evaporator of the refrigerator is less than or equal to a second preset temperature threshold, and invoking a cooling mode to resume heat exchange between the evaporator and the compartment of the refrigerator back to the heat exchange amount before being reduced, wherein the first preset temperature threshold is higher than the second preset temperature threshold;

a temperature sensor inside the refrigerator compartment configured for collecting the temperature in the refrigerator compartment;

a temperature sensor outside the refrigerator compartment configured for collecting an ambient temperature; and in the noise reduction mode, controlling the linear compressor to turn on or turn off according to the temperature in the compartment of the refrigerator, setting a plurality of consecutive temperature intervals corresponding to the ambient temperature, setting operation parameters of the linear compressor corresponding to each interval, and operating the linear compressor according to corresponding operation parameters.

7. The refrigerator adopting a linear compressor according to claim 6, wherein the noise reduction mode comprises:

closing a blower of the refrigerator and/or an air door of the compartment.

8. The refrigerator adopting a linear compressor according to claim 6, wherein the evaporator of the refrigerator comprises a refrigeration evaporator and a freezing evaporator, the first preset temperature threshold comprises a first preset refrigeration temperature threshold and a first preset freezing temperature threshold, the second preset temperature threshold comprises a second preset refrigeration temperature threshold and a second preset freezing temperature threshold:

the evaporator temperature sensor comprises a refrigeration evaporator temperature sensor configured for monitoring temperature of the refrigeration evaporator of the refrigerator; and a freezing evaporator temperature sensor configured for monitoring temperature of the freezing evaporator of the refrigerator;

if a current temperature of the refrigeration evaporator of the refrigerator is greater than or equal to the first preset refrigeration temperature threshold, then invoking a refrigeration noise reduction mode to actively reduce a first heat exchange amount between the refrigeration evaporator and a refrigeration compartment of the refrigerator until the current temperature of the refrigeration evaporator is less than or equal to the second preset refrigeration temperature threshold, and invoking a refrigeration cooling mode to resume heat exchange between the refrigeration evaporator and the refrigeration compartment back to the first heat exchange amount before being reduced, wherein the first preset refrigeration temperature threshold is higher than the second preset refrigeration temperature threshold; and if a current temperature of the freezing evaporator of the refrigerator is greater than or equal to the first preset freezing temperature threshold, then invoking a freezing noise reduction mode to actively reduce a second heat exchange amount between the freezing evaporator and a freezing compartment of the refrigerator until the current temperature of the freezing evaporator is less than or equal to the second preset freezing temperature threshold, and invoking a freezing cooling mode to resume heat exchange between the freezing evaporator and the freezing compartment back to the second heat exchange amount before being reduced, wherein the first preset freezing temperature threshold is higher than the second preset freezing temperature threshold.

9. The refrigerator adopting a linear compressor according to claim 8, wherein the refrigeration noise reduction mode comprises:

closing a blower of the refrigeration compartment and/or an air door of the refrigeration compartment; and the freezing noise reduction mode comprises:

closing a blower of the freezing compartment and/or an air door of the freezing compartment.

10. The refrigerator adopting a linear compressor according to claim 8, further comprising:

a refrigeration compartment temperature sensor configured for collecting the temperature in the refrigerator compartment;

a freezing compartment temperature sensor configured for collecting the temperatures in the freezing compartment;

a temperature sensor outside the refrigerator compartment configured for collecting an ambient temperature; and in the refrigeration noise reduction mode, controlling the linear compressor to turn on or turn off according to the temperature in the refrigeration compartment, setting a plurality of consecutive temperature intervals corresponding to the ambient temperature, setting operation parameters of the linear compressor corresponding to each interval, and operating the linear compressor according to corresponding operation parameters; and in the freezing noise reduction mode, controlling the linear compressor to turn on or turn off according to the temperature in the freezing compartment, setting a plurality of consecutive temperature intervals corresponding to the ambient temperature, setting operation parameters of the linear compressor corresponding to each interval, and operating the linear compressor according to corresponding operation parameters.

* * * * *